United States Patent [19]

Yokoyama et al.

[11] Patent Number: 4,722,885

[45] Date of Patent: Feb. 2, 1988

[54] PHOTOGRAPHIC LIGHT-SENSITIVE MATERIAL CONTAINING A SPECIFIED GRAFT POLYMER OR COPOLYMER

[75] Inventors: Shigeki Yokoyama; Junichi Yamanouchi; Masakazu Yoneyama; Yukio Maekawa, all of Kanagawa, Japan

[73] Assignee: Fuji Photo Film Co., Ltd., Kanagawa, Japan

[21] Appl. No.: 710,256

[22] Filed: Mar. 11, 1985

[30] Foreign Application Priority Data

Mar. 9, 1984 [JP] Japan ..... 59-44974

[51] Int. Cl.[4] ..... G03C 1/78; G03C 2/06

[52] U.S. Cl. ..... 430/531; 430/536; 430/545; 430/548; 430/609; 430/607; 430/627; 430/930; 430/961

[58] Field of Search ..... 430/531, 536, 545, 548, 430/609, 607, 627, 909, 910, 930, 961

[56] References Cited

U.S. PATENT DOCUMENTS

| | | | |
|---|---|---|---|
| 3,026,293 | 3/1962 | Caldwell et al. | 430/536 |
| 3,786,116 | 1/1974 | Milkovich et al. | 525/242 X |
| 4,201,589 | 5/1980 | Sakaguchi et al. | 430/627 X |
| 4,229,524 | 10/1980 | Yoneyama et al. | 430/536 |
| 4,358,533 | 11/1982 | Tokitou et al. | 430/531 X |
| 4,594,315 | 6/1986 | Shibue et al. | 430/536 X |

FOREIGN PATENT DOCUMENTS

| | | | |
|---|---|---|---|
| 0080225 | 1/1983 | European Pat. Off. | 430/517 |

OTHER PUBLICATIONS

Windholz et al, eds, *The Merck Index: An Encyclopedia of Chemicals and Drugs,* Ninth Ed., Merck & Co., Inc., Rahway, N.J., 1976, pp. 499–500.

*Primary Examiner*—John E. Kittle
*Assistant Examiner*—Cynthia Hamilton
*Attorney, Agent, or Firm*—Sughrue, Mion, Zinn, Macpeak & Seas

[57] ABSTRACT

A photographic material is described, comprising at least one layer containing at least one of (i) a polymer of a compound represented by formula (I)

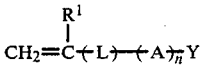

(I)

wherein $R^1$ represents a hydrogen atom or an alkyl group having from 1 to 6 carbon atoms, L represents a divalent organic linking group, A represents a divalent organic linking group derived from a polymerizable monomer unit, n represents an average degree of polymerization and is a number of at least 2, and Y represents a monovalent organic bonding group and (ii) a copolymer of the compound represented by formula (I) with a copolymerizable ethylenically unsaturated monomer.

20 Claims, No Drawings

PHOTOGRAPHIC LIGHT-SENSITIVE MATERIAL CONTAINING A SPECIFIED GRAFT POLYMER OR COPOLYMER

FIELD OF THE INVENTION

This invention relates to a photographic element containing a particular polymer for photography.

BACKGROUND OF THE INVENTION

In the field of photography, polymeric compounds are used in a photographic element constituting a photographic light-sensitive material, such as a support layer, an undercoat layer, an intermediate layer, an emulsion layer, a protective layer, a backing layer, an image receiving layer, a barrier layer, a timing layer, an antihalation layer, an antistatic layer, a peeling layer, a mordant layer and a scavenger layer, as described, e.g., in *Shell Polymer,* Vol. 5, p. 15 (1981). These compounds include various species, for example, natural polymers and their derivatives such as gelatin and acetylcellulose, polycondensation polymers such as polyethylene terephthalate, polymers derived by ring opening polymerization such as polyethylene oxide, and polymers derived by vinyl polymerization such as polyvinyl pyrrolidone and polyvinyl alcohol. As many ethylenically unsaturated monomers have recently been developed with advances in the synthetic polymer industry, polymeric compounds obtained by vinyl polymerization have come into widespread use. Although many homopolymers of ethylenically unsaturated monomers are used as such polymeric compounds obtained by vinyl polymerization, the recent trend has been to use in greater quantities copolymers of dissimilar ethylenically unsaturated monomers as photographically useful polymeric compounds having many functions in order to meet the requirements for improved photographic properties such as "instantaneous photographing" and "increased sensitivity". Many patent applications have been filed and published which are directed to the use of polymeric compounds obtained by copolymerization as part of photographic elements.

Generally, many such copolymers are "random copolymers", in which the constituent units of dissimilar ethylenically unsaturated monomers are arranged at random. Since the mixing of dissimilar ethylenically unsaturated monomers in the preparation of the "random copolymer" is monomer-with-monomer mixing, it is easy to obtain a homogeneous polymeric compound. However, in many cases, properties which supplement or complete the properties of homopolymers of the individual components cannot be fully exhibited in such copolymers because of the interaction of the individual components. Hence, such random copolymers cannot fully meet the high and various requirements for the functions of polymeric compounds.

In order to meet the high requirements for the functions of polymeric compounds, not only have "random copolymers" been utilized, but also the utilization of composites of polymeric materials having more complicated structures have been extensively studied in recent years. One specific example is the use of "graft copolymers" (or more simply "graft polymers") composed of a single or multiple polymeric chains and a graft of another polymer attached thereto. Generally, two dissimilar polymers are not miscible and so-called "phase separation" occurs. This constitutes a great drawback in polymer blending. The "graft polymers", however, have the outstanding characteristic that since the two different polymers are chemically bound to each other, their phase separation does not form two completely independent phases, but rather microphase separation occurs to form a multiphase structure.

A detailed description of graft polymers is given, for example, in Fumio Ide, *Graft Polymerization and Its Application,* (Kobunshi Kankokai, 1977) and in *Polymer Alloy* (edited by the Japanese Polymer Society and published by Tokyo Kagaku Dojin, 1981). Many examples have been reported in which graft polymers having above properties were applied to reform the surface of polymers.

For example, *Polymer Bulletin,* Vol. 7, p. 289 (1982) states that when a graft polymer composed of a trunk (backbone polymer) of a fluoroalkyl acrylate and a branch (a grafting portion) of methyl methacrylate is formed into a film on a glass plate, the hydrophilic property and hydrophobic property of the surface of the polymer film vary greatly depending upon its environment. Thus, because of these properties, the graft polymer can impart properties not obtainable from "random copolymers", for example, wetting property, adhesion, antistatic property, and oil-repellency to the resulting hydrophilic surface, and water-repellency, reduction of friction (lubrication), and adhesion resistance to the hydrophobic surface.

Furthermore, the application of graft polymers to photography is described, for example, in U.S. Pat. No. 4,359,517, Japanese Patent Application (OPI) Nos. 75236/73 and 41490/80 (the term "OPI" as used herein refers to a "published unexamined Japanese patent application"), and West German Patent Application (OLS) No. 2,311,207.

The graft polymers described in these patent documents are produced by polymerizing a dissimilar low molecular weight monomer using as an initiation point the functional groups of a linear backbone polymer. A typical example is the polymerization of acrylamide to polyvinyl alcohol catalyzed by Ce (IV), described in Takayuki Otsu and Gaetsu Kinoshita, *Experimental Methods in Polymer Chemistry,* (Kagaku Dojin) at page 387 (1972). Such a synthesizing method, however, generally has the disadvantage that a homopolymer of a dissimilar monomer component gets mixed and a graft polymer of high purity is difficult to obtain, and that the length and number of grafts are difficult to control. For this reason, these graft polymers have a very weak effect of exhibiting a function attributed to the multiphase structure described hereinabove, and in application to reforming the surface of polymers, they must be added in relatively large amounts. Furthermore, the inclusion of the homopolymer of a dissimilar monomer component may prevent the graft polymers from exhibiting their function. A further defect is that in a photographic system, commerical value of a graft polymer is reduced greatly owing to staining, fogging, and desensitization caused by bleeding or diffusion of the graft polymer to another layer.

SUMMARY OF THE INVENTION

A first object of this invention is to provide a photographic element having a reformed surface.

A second object of this invention is to provide a photographic element having improved adhesion between photographic layers.

A third object of this invention is to provide a photographic element having adhesion resistance to foreign substances.

A fourth object of this invention is to provide a photographic element having a reformed surface which suffers little from bad effects such as bleeding of diffusible homopolymer of a dissimilar monomer or an unreacted monomer, and staining, fogging, and desensitization by such homopolymer or unreacted monomer.

A fifth object of this invention is to provide a photographic element in which the haze of a coated film is reduced.

According to this invention, it has now been found that by synthesizing a graft polymer by the polymerization of a compound of the following formula (I), or the copolymerization of the compound of formula (I) and a copolymerizable ethylenically unsaturated monomer, and introducing the graft polymer into at least one layer of a photographic element, photographically useful properties not attainable by graft polymers obtained by conventional synthetic methods can be imparted to the photographic element.

Formula (I) is represented by

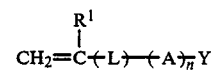

(I)

In formula (I), $R^1$ represents a hydrogen atom or an alkyl group having from 1 to 6 carbon atoms, L represents a divalent organic group, A represents a divalent organic group derived from a polymerizable monomer unit, n represents an average degree of polymerization and is a number of at least 2, and Y represents a monovalent organic group.

DETAILED DESCRIPTION OF THE INVENTION

Polymerizable ethylenically unsaturated monomers represented by formula (I) are also called macromers, macromonomers, or macromolecular monomers, and are described, for example, in Yuya Yamashita, *Journal of the Japanese Association of Adhesion,* Vol. 17, page 371 (1981), and Yuhsuke Kawakami and Yuka Yamashita, *Chemistry,* Vol. 37, page 20 (1982).

The compounds of formula (I) in accordance with this invention are described below in further detail.

Examples of the "alkyl group" represented by $R^1$ include methyl, ethyl, n-propyl, isopropyl, n-butyl, isobutyl and n-hexyl groups. $R^1$ is preferably a hydrogen atom or a methyl group.

Examples of the polymerizable monomer from which the divalent organic group represented by A is derived are ethylenically unsaturated monomers, ring opening polymerizable cyclic monomers, and monomers capable of polycondensation or polyaddition.

Examples of the ethylenically unsaturated monomers for A include ethylene, propylene, 1-butene, isobutene, styrene, α-methylstyrene, vinyltoluene, monoethylenically unsaturated esters of aliphatic acids (such as vinyl acetate and allyl acetate), esters of ethylenically unsaturated mono- or dicarboxylic acids (such as methyl methacrylate, ethyl acrylate, hydroxyethyl methacrylate, n-butyl acrylate, n-butyl methacrylate, n-hexyl methacrylate, n-octyl acrylate, benzyl acrylate, cyclohexyl methacrylate, 2-ethylhexyl acrylate, stearyl methacrylate and perfluorooctylethyl methacrylate), monoethylenically unsaturated compounds (such as acrylonitrile, methacrylonitrile and N-vinylpyrrolidone), and dienes (such as butadiene and isoprene). Of these, N-vinylpyrrolidone, stearyl methacrylate, styrene, methyl methacrylate and hydroxyethyl methacrylate are preferred.

Examples of the ring opening polymerizable monomers for A include cyclic ethers (such as ethylene oxide, propylene oxide and tetrahydrofuran), cyclic formals (such as trioxane), cyclic imines (such as ethyleneimine) and N-carboxy-α-amino acid anhydride. Such monomers are described in detail in Takeo Saegusa, *Ring-Opening Polymerization* (Kagaku Dojin (1971)). These polymers are usually obtained by ionic polymerization.

A combination of an N,N'-dialkyldiamine (such as N,N'-diethylethylenediamine) and divinylbenzene is an example of the monomers for A capable of polyaddition. Examples of the polycondensable monomers for A are amino acids (such as ε-aminocaproic acid) and 4-chloro-4'-hydroxydiphenylsulfone.

Also, A may contain two or more such monomer units.

The structure of the divalent organic linking group represented by L is properly selected depending upon the mode of polymerization of A. When the monomer unit for A is subjected to radical polymerization, the polymerization is carried out in the combined use of a chain transfer agent containing a carboxyl group, a hydroxyl group, an amino group, or a substituted amino group, to thereby introduce the functional group into the terminals of the polymer chain. Preferably, an initiator having the same functional group as the above may be used at this time. By using these terminal functional groups as a starting point, the vinyl group is introduced to form the compound of formula (I).

Suitable chain transfer agents that can be used for this purpose include carboxyl group-containing compounds (such as thioglycolic acid, 3-mercaptopropionic acid, 2-iodoacetic acid, 2-mercapto-2-methylpropionic acid, and thiosalicylic acid), hydroxyl group-containing compounds (such as 2-mercaptoethanol), and amino group-containing compounds (such as 2-mercaptoethylamine hydrochloride and N-(2-mercaptoethyl)-N-ethylamine hydrochloride). These chain transfer agents can be suitably selected depending upon the reactivity of the monomer for A.

The vinyl group corresponding to

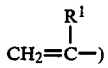

is introduced as follows into the resulting polymer having terminal functional groups.

COOH-Terminated Polymers:

Reaction with glycidyl (meth)acrylate, vinyl esters, allyl alcohol, etc.

OH-Terminated Polymers:

Reaction with (methy)acryloyl chloride, vinyl isocyanate, etc.

$NH_2$ (or NHR)-Terminated Polymers:

Reaction with (meth)acryloyl chloride, (meth)acrylic acid, vinyl isocyanate, etc.

The compounds of formula (I) having vinyl groups at the terminals can be synthesized by the foregoing techniques. Details of such techniques are described in British Pat. No. 1,096,912.

The compound of formula (I) can also be derived by addition reaction between a diisocyanate (such as tolylene diisocyanate) and the carboxyl group, as described in U.S. Pat. No. 3,689,593.

When $-(A)_n-$ is synthesized by a radical polymerization method, examples of preferred linking groups L are as follows:

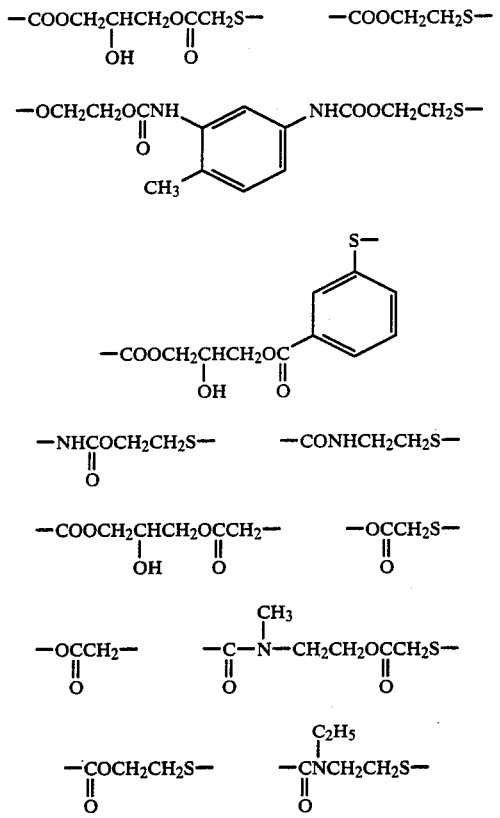

The compound of formula (I) obtained by the ionic polymerization of A can usually be synthesized by coupling (end-capping) with a compound containing a vinyl group at the time of stopping the polymerization, or by using an initiator containing a vinyl group. Examples of such a coupling agent are as follows:

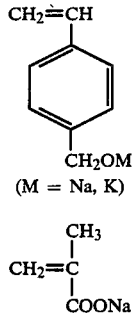

An example of the initiator having a vinyl group is as follows:

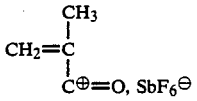

Synthesis by this method is described, for example, in the *Journal of Applied Polymer Science,* Vol. 27, No. 12, p. 4773 (1982), and *Polymer Bulletin,* Vol. 3, p. 83 (1980).

Preferred examples of the group L in the case of synthesizing $-(A)_n-$ by ionic polymerization are set forth below.

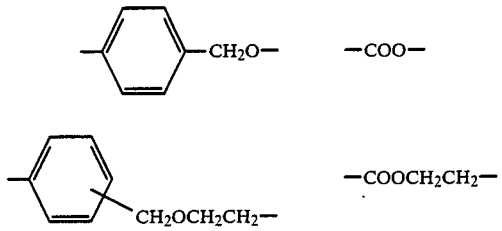

Preferred examples of the group L of the compound of formula (I) when it is obtained by polycondensation or polyaddition of A are set forth below.

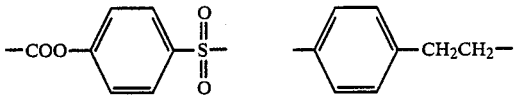

In formula (I), n represents an average degree of polymerization and is a number of at least 2, and is preferably 3 to 100. Y represents a monovalent organic group. Y is usually introduced either by the initiation reaction or the stopping reaction of the polymerization. Examples of Y include hydrogen, iodine, a methyl group, a sec-butyl group and a phenoxy group.

The polymer or copolymer used in this invention is preferably a graft polymer represented by formula (II).

Formula (II) is represented by

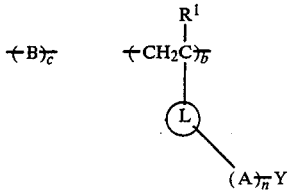

(II)

wherein $R^1$, L, A, n and Y are the same as defined above for formula (I).

B represents at least one copolymerizable ethylenically unsaturated monomer. The range of c is from 0 to 99.99 mol%, and b is from 0.01 to 100 mol%.

Examples of the ethylenically unsaturated monomer B include ethylene, propylene, 1-butene, isobutene, styrene, α-methylstyrene, vinyltoluene, monoethylenically unsaturated esters of aliphatic acids (such as vinyl acetate and allyl acetate), esters of ethylenically unsaturated mono- or dicarboxylic acids (such as methyl methacrylate, ethyl acrylate, hydroxyethyl acrylate, hydroxyethyl methacrylate, n-butyl acrylate, n-butyl methacrylate, n-hexyl methacrylate, n-octyl acrylate, benzyl acrylate, cyclohexyl methacrylate, 2-ethylhexyl acrylate, stearyl methacrylate, and perfluorooctylethyl methacrylate), monoethylenically unsaturated compounds (such as acrylonitrile, methacrylonitrile, and N-vinylpyrrolidone), and dienes (such as butadiene and isoprene). Of these, N-vinylpyrrolidone, stearyl methacrylate, styrene, methyl methacrylate, and hydroxyethyl methacrylate are preferred. B may contain at least two such monomer units as described above.

The range of c is preferably from 80 to 99.99 mol%, and b is preferably from 0.01 to 20 mol%.

A method for producing the macromonomer represented by formula (I), the method for producing graft polymers using the macromonomer, and their properties are described not only in the literature references cited hereinabove, but also, for example, in U.S. Pat. Nos. 3,786,116 and 3,842,050; Y. Yamashita et al., *Macromolecules,* Vol. 13, p. 216 (1980); Kawakami et al., *Journal of Polymer Science, Polymer Letter Edition,* Vol. 19, p. 629 (1981); R. Asami et al., *Polymer Bulletin,* Vol. 2, p. 713 (1980); Kawakami et al., *Polymer Journal,* Vol. 14, p. 913 (1982); Nitadori and Tsuruta, *Die Makromolecular Chemie,* Vol. 180, p. 1877 (1979); M. Maeda et al., *Die Makromolecular Chemie, Rapid Communication,* Vol. 2, p. 537 (1981); and Percec et al., *Polymer Bulletin,* Vol. 10, p. 215 (1983).

Preferred examples of graft polymers synthesized in accordance with this invention are listed below.

1.

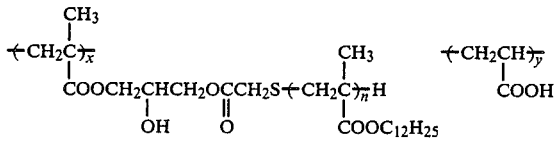

n = 20
x/y = 1/99

2.

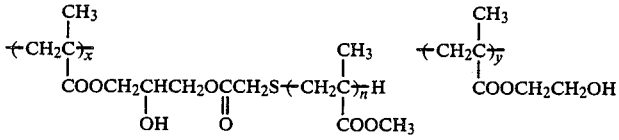

n = 15
x/y = 3/97

3.

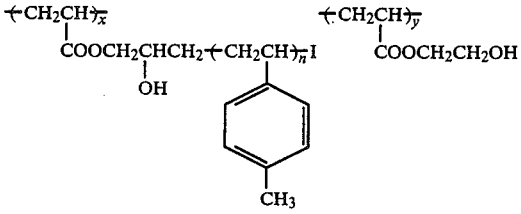

n = 50
x/y = 2/98

4.

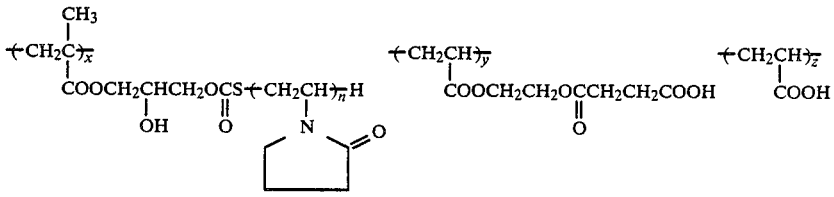

n = 20
x/y/z = 10/10/80

5.

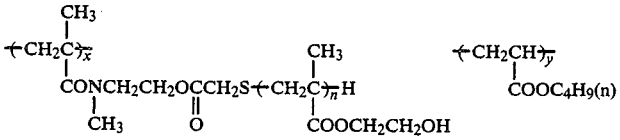

n = 30
x/y = 0.5/99.5

6.

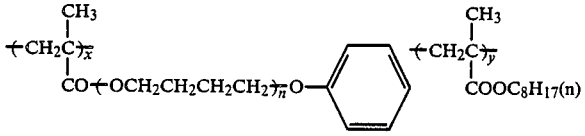

n = 100
x/y = 2/98

-continued

7.

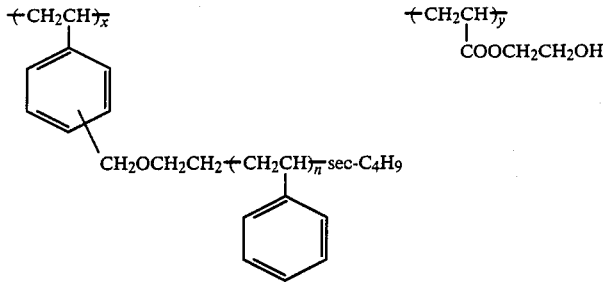

n = 50
x/y = 1/99

8.

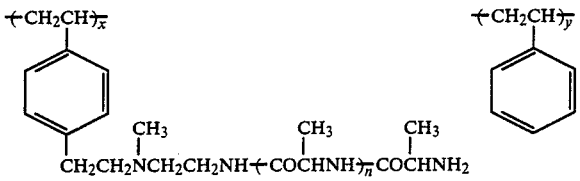

n = 10
x/y = 5/95

9.

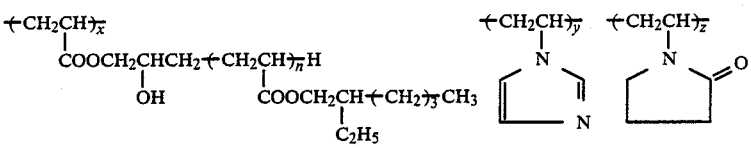

n = 20
x/y/z = 5/45/50

10.

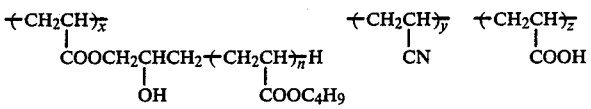

n = 15
x/y/z = 5/75/10

Examples of synthesis of graft polymers according to this invention are described below.

SYNTHESIS EXAMPLE 1

(i) Synthesis of a Macromer

A 2-liter three-necked flask equipped with a stirrer and a reflux condenser was charged with 300 ml of ethyl acetate and 300 ml of xylene, and they were heated to 70° C. in a stream of nitrogen. 500 g of lauryl methacrylate, 10 ml of thioglycolic acid and a solution with 5 g of 2,2'-azobis(2,4-dimethylvaleronitrile) dissolved in 200 ml of ethyl acetate was added dropwise at the same dropping speed with stirring over 3 hours. After the addition, the mixture was heated, and with stirring, refluxed under heating for 3 hours. Ethyl acetate was distilled off under reduced pressure. Glycidyl methacrylate (4 ml) and 0.5 ml of dimethyllaurylamine were added to the cooled lauryl methacrylate polymer solution, and the mixture was refluxed under heating for 5 hours. The product was repeatedly reprecipitated by addition of n-hexane, and dried to obtain 260 g of polylauryl methacrylate macromer.

The number average molecular weight of the macromer measured by gel-permeation chromatography was 5,500.

(ii) Synthesis of a Graft Polymer

A 500 ml three-necked flask equipped with a stirrer and a reflux condenser was charged with 15 g of the above polylauryl methacrylate macromer, 15 g of acrylic acid and 150 ml of N,N-dimethylformamide, and they were heated to 70° C. in a stream of nitrogen. A solution with 0.13 g of 2,2'-azobis-(2,4-dimethylvaleronitrile) dissolved in 10 ml of N,N-dimethylformamide was added, and the mixture was heated with stirring for 4 hours. Further, 0.25 g of 2,2'-azobis-(2,4-dimethylvaleronitrile) was added, and the mixture was heated with stirring for 1 hour. The mixture was heated to 85° C., and stirred at this temperature (85° C.) for 2 hours. After cooling, the reaction mixture was repeatedly reprecipitated by addition of n-hexane/acetone (1/1), and dried to obtain 26 g of a graft polymer of the following structure.

GP-1

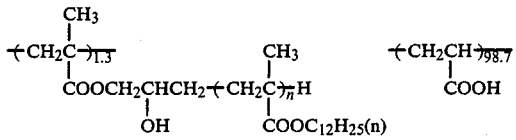

n ≈ 21

SYNTHESIS EXAMPLE 2

In the same way as in Synthesis Example 1, the following graft polymer was synthesized via a macromonomer.

GP-2

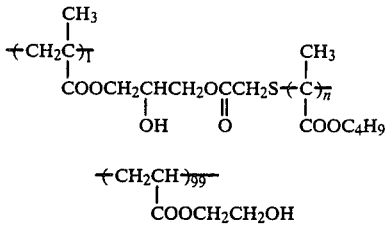

n = 30

The present invention can be applied to various photographic materials, for example, ordinary black-and-white silver halide light-sensitive materials (such as black-and-white silver halide light-sensitive materials for photography, for X-ray photography, and also for printing), and ordinary multilayer color light-sensitive materials (such as color reversal films, color negative films, and color positive films).

The invention can also be applied to diffusion transfer process photographic materials (such as peelable black-and-white diffusion transfer photographic films, peelable color diffusion transfer photographic films, and monosheet type color diffusion transfer photographic films).

The amount of the graft polymer in accordance with this invention differs depending upon the type and form of the photographic light-sensitive materials in which it is used, the method of coating, etc. Generally, however, the suitable amount of the graft polymer used is from 0.001 to 2.0 g, and preferably from 0.001 to 0.5 g, per $m^2$ of the photographic light-sensitive material.

An example is shown below of the use of a graft polymer synthesized in accordance with this invention for improvement of the adhesion between a neutralization timing layer and a neutral acid polymer layer in a color diffusion transfer photographic material.

EXAMPLE 1

A light-sensitive sheet was prepared by coating layers (1) to (11) successively on a black support.

(1) A layer containing the following cyan dye redox releasing (DRR) compound (0.40 g/$m^2$), tricyclohexyl phosphate (0.10 g/$m^2$), 2,5-di(t-pentadecyl)hydroquinone (0.01 g/$m^2$) and gelatin (0.8 g/$m^2$).

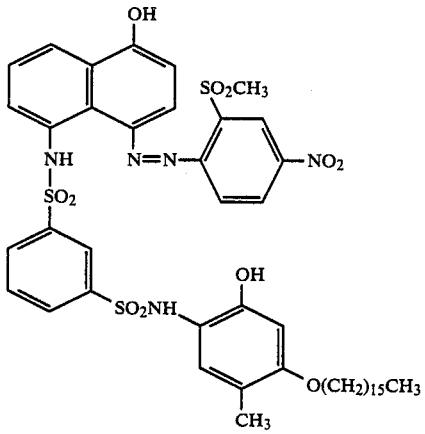

(2) A layer containing a red-sensitive internal latent image type direct reversal silver bromide emulsion (1.03 g/$m^2$ as silver), gelatin (1.2 g/$m^2$), the following nucleating agent (0.05 mg/$m^2$) and sodium pentadecylhydroquinonesulfonate (0.13 g/$m^2$).

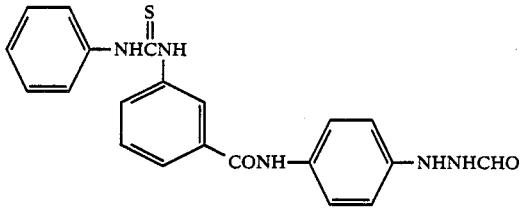

(3) A layer containing 2,5-di(tert-pentadecyl)hydroquinone (0.71 g/$m^2$), a vinylpyrrolidone/vinyl acetate (molar ratio 7/3) copolymer (0.24 g/$m^2$) and gelatin (0.6 g/$m^2$).

(4) A layer containing gelatin (0.4 g/$m^2$).

(5) A layer containing the following magenta DRR compound (0.32 g/$m^2$), tricyclohexyl phosphate (0.08 g/$m^2$), 2,5-di(tert-pentadecyl)hydroquinone (0.01 g/$m^2$) and gelatin (0.6 g/$m^2$).

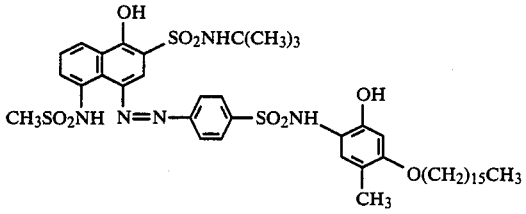

(6) A layer containing a green-sensitive internal latent image type direct reversal silver bromide emulsion (0.82 g/$m^2$ as silver), gelatin (0.9 g/$m^2$), the same nucleating agent as in (2) (0.03 mg/$m^2$) and sodium pentadecylhydroquinonesulfonate (0.08 g/$m^2$).

(7) A layer containing 2,5-di(tert-pentadecyl)hydroquinone (0.71 g/$m^2$), a vinylpyrrolidone/vinyl acetate (molar ratio 7/3) copolymer (0.24 g/$m^2$) and gelatin (0.6 g/$m^2$).

(8) A layer containing gelatin (0.4 g/$m^2$).

(9) A layer containing the following yellow DRR compound (0.53 g/$m^2$), tricyclohexyl phosphate (0.13 g/$m^2$), 2,5-di(tert-pentadecyl)hydroquinone (0.01 g/$m^2$) and gelatin (0.7 g/$m^2$).

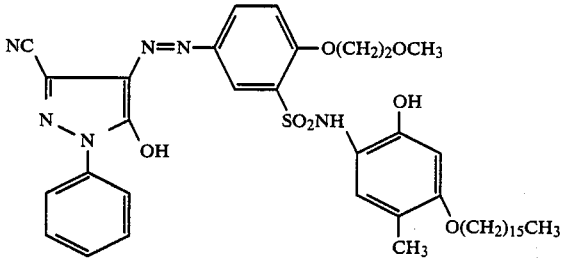

(10) A layer containing a blue-sensitive internal latent image type direct reversal silver bromide emulsion (1.09 g/$m^2$ as silver), gelatin (1.1 g/$m^2$), the same nucleating agent as in layer (2) (0.04 mg/$m^2$) and sodium pentadecylhydroquinonesulfonate (0.07 g/$m^2$).

(11) A layer containing gelatin (1.09 g/$m^2$) and 1,2-bis(vinylsulfonyl)acetamide (40 mg/$m^2$).

Six dye image receiving sheets (a) to (f) were prepared by successively coating the following layers (12) to (16) on a white support whose back surface had been successively coated with carbon black and titanium white. The layer (12) or (13) was varied as described hereinafter.

(12) An acid polymer layer.

(13) A neutralization timing layer.

(14) A layer containing a copolymer of vinylidene chloride, methyl acrylate, and acrylic acid in a weight ratio of 85/12/3 (2.5 g/m$^2$) and a polymethyl methacrylate latex having an average particle diameter of 1 to 3 microns (0.05 g/m$^2$).

(15) A layer containing poly(N-methyl-N-vinylbenzylpiperidinium chloride-co-styrene-co-divinylbenzene) (3.0 g/m$^2$) and gelatin (3.0 g/m$^2$).

(16) A layer containing phthalated gelatin (1 g/m$^2$).

The image receiving sheet (a) for comparison was prepared by using the following layers (12) and (13).

(12) A layer containing acrylic acid polymer (10 g/m$^2$) and 1,4-bis(2,3-epoxypropoxy)butane (0.44 g).

(13) A layer containing acetyl cellulose (when 100 g of acetyl cellulose is hydrolzed, 39.4 g of an acetyl group forms) (3.8 g/m$^2$), a copolymer of styrene and maleic anhydride in a weight ratio of 60/40 (molecular weight: about 50,000) (0.2 g/m$^2$), and 5-(β-cyanoethylthio)-1-phenyltetrazole (0.115 g/m$^2$).

The image receiving sheet (b) for comparison was prepared by adding 4 g/m$^2$ of a random copolymer of the following structural formula to the layer (12) of the comparative sheet (a) and using the same layer (13) as the comparative sheet (a).

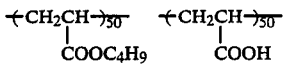

The image forming sheets (c) and (d) for comparison were prepared respectively by adding 0.2 g/m$^2$ or 4 g/m$^2$ of a graft polymer of the following structural formula to the layer (12) of the comparative sheet (a), and using the same layer (13) as the comparative sheet (a).

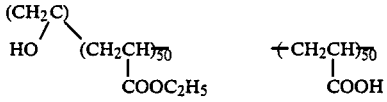

The above compound, as described in Japanese Patent Application (OPI) No. 75236/73, was synthesized by graft polymerizing a dissimilar monomer (ethyl acrylate, acrylic acid) to a backbone polymer (polyvinyl alcohol).

The image receiving sheet (e) was prepared by adding 0.2 g/m$^2$ of the graft polymer GP-1 (the compound of Synthesis Example 1) of the present invention to the layer (12) of the comparative sheet (a), and using the same layer (13) as the comparative sheet (a).

The image receiving sheet (f) was prepared by adding 0.1 g/m$^2$ of the graft polymer GP-2 (the compound of Synthesis Example 2) of this invention to the layer (13) of the comparative sheet (a) and using the same layer (12) as the comparative sheet (a).

The light-sensitive sheet was exposed through a color test chart, and the dye image receiving sheet was superimposed on it. By a pressing member, the following processing liquor (III) was developed to a thickness of 60 μm and 2 minutes later, the sheets were peeled apart from each other.

| Processing Liquor (III) | |
|---|---|
| Benzyl Alcohol | 0.20 ml |
| 1-(p-Tolyl)-4-hydroxymethyl-4-methyl pyrazolidinone | 0.3 g |
| Methylhydroquinone | 0.012 g |
| 5-Methylbenzotriazole | 0.6 g |
| Sodium Sulfite | 0.18 g |
| Hydroxymethyl Cellulose | 4 g |
| Potassium Hydroxide (28% aq. soln.) | 22.4 ml |
| $H_2O$ | 67 ml |

The surface of each of the image receiving sheets (a) to (f) was cut in a latticework by a cutter, and a Mylar tape was bonded to the surface. The tape was peeled off, and the areas of the images lost upon peeling were compared. The smaller the lost area, the better the adhesion. Furthermore, the hazes of the images were compared by visual observation.

The results are shown in Table 1. As compared with the control image receiving sheet (a), scarcely any effect of improving adhesion was seen in the comparison (b), in which the random copolymer was added, but rather the haze of the image slightly increased. With the comparisons (c) and (d), in which the graft polymer synthesized by a method other than the macromonomer method was added, the adhesion was improved by increasing the amount of the graft polymer, but the haze of the image also increased. The graft polymer in accordance with this invention improves the adhesion even when added in an amount of as small as 0.2 g/m$^2$, and the haze of the image hardly increased. The same excellent effect was produced irrespective of whether it was added to the timing layer or to the acid polymer layer.

TABLE 1

| Image Receiving Sheet | Area of the Image Peeled Apart by the Tape (percentage based on its entire area) (%) | Haze of the Image |
|---|---|---|
| Comparison (a) | 65 | Good |
| Comparison (b) | 60 | Slightly Poor |
| Comparison (c) | 30 | Good |
| Comparison (d) | 5 | Slightly Poor |
| (e) | 0 | Good |
| (f) | 0 | Good |

EXAMPLE 2

A cover sheet (a') for comparison was prepared as follows:

The following layers were successively coated on a polyethylene terephthalate support to prepare a cover sheet.

(1') A neutralization layer obtained by coating a 22 g/m$^2$ of an acrylic acid/butyl acrylate (molar ratio 8/2) copolymer having an average molecular weight of 50,000.

(2') A neutralization timing layer obtained by coating a 4.5 g/m$^2$ of a cellulose acetate having an acetyl value of 51.3% (the weight of acetic acid released by hydrolysis was 0.513 g per gram of cellulose acetate) and a styrene/maleic anhydride (molar ratio 1/1) copolymer having an average molecular weight of about 10,000 in a weight ratio of 95/5.

(3') A layer containing a vinylidene chloride/methyl acrylate/acrylic acid (weight ratio of 85/12/3) copolymer latex (2.5 g/m$^2$) and polymethyl methacrylate latex having an average particle diameter of 1 to 3 μm (0.05 g/m$^2$).

A cover sheet (b') for comparison was prepared by adding 4 g/m$^2$ of a random copolymer of the following structural formula to the layer (1') of the cover sheet (a') with the other layers being the same as in the cover sheet (a').

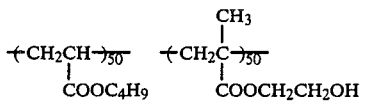

Cover sheets (c') and (d') for comparison were prepared by adding 0.2 g/m$^2$ or 4 g/m$^2$ of a graft polymer of the following structural formula to the layer (1') of the cover sheet (a') with the other layers being the same.

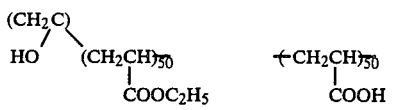

The above compound, described in Japanese Patent Application (OPI) No. 75236/73, was synthesized by graft polymerizing a dissimilar monomer (ethyl acrylate, acrylic acid) to a backbone polymer (polyvinyl alcohol).

A cover sheet (e') was prepared by adding 0.2 g/m$^2$ of the graft polymer GP-1 of the invention (the compound of Synthesis Example 1) to the layer (1') of the cover sheet (a') and using the same layers (2') and (3') as in the cover sheet (a').

A cover sheet (f') was prepared by adding 0.1 g/m$^2$ of the graft polymer GP-2 of the invention (the compound of Synthesis Example 2) to the layer (2') of the cover sheet (a') and using the same layers (1') and (3') as in the cover sheet (a').

The surface of each of the cover sheets (a') to (c') was cut in a latticework by a cutter, and a Mylar tape was bonded to the surface. The areas of the peeled films upon peeling were compared.

In so-called monosheet type instant photography as described in British Pat. No. 1,330,524, poor adhesion between the layers of a cover sheet may cause liquid leakage during low temperature processing, and thus the cover sheet is required to have strong adhesion between layers.

As shown by the results in Table 2, the addition of the random copolymer did not achieve an improvement in adhesion over the cover sheet (a') used as a control. With the cover sheets (c') and (d') in which the graft polymer obtained by a method other than the macromer method was added, the adhesion was improved by increasing the amount of the polymer, but the improvement was not complete. With the graft polymer of this invention, the adhesion was strikingly improved even when it was added in an amount of as small as 0.2 g/m$^2$.

TABLE 2

| Cover Sheet | Area of the Peeled Film of the Tape (percentage based on the entire image area) (%) |
|---|---|
| Comparison (a') | 90 |
| Comparison (b') | 90 |
| Comparison (c') | 85 |
| Comparison (d') | 30 |
| (e') | 0 |
| (f') | 0 |

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising at least one layer containing at least one of (i) a polymer of a compound represented by formula (I)

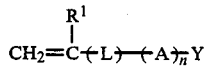

(I)

wherein $R^1$ represents a hydrogen atom or an alkyl group having from 1 to 6 carbon atoms, L represents a divalent organic group, A represents a divalent organic group derived from an ethylenically unsaturated unit, n represents an average degree of polymerization and is a number of at least 2, and Y represents a monovalent organic group and (ii) a copolymer of the compound represented by formula (I) with a copolymerizable ethylenically unsaturated monomer.

2. A photographic light-sensitive material as in claim 1, wherein $R^1$ is a hydrogen atom or a methyl group.

3. A photographic light-sensitive material as in claim 1, wherein n is from 3 to 100.

4. A photographic light-sensitive material as in claim 2, wherein n is from 3 to 100.

5. A photographic light-sensitive material as in claim 1, wherein said polymer or copolymer is represented by formula (II)

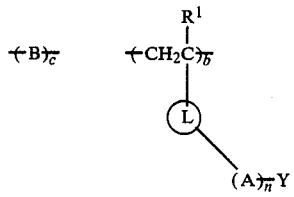

(II)

wherein $R^1$ represents a hydrogen atom or alkyl group having from 1 to 6 carbon atoms, L represents a divalent organic group, A represents a divalent organic group derived from an ethylenically unsaturated monomer unit, n represents an average degree of polymerization and is a number of at least 2, Y represents a monovalent organic group, B represents at least one copolymerizable ethylenically unsaturated monomer, and the range of c is from 0 to 99.99 mol% and b is from 0.01 to 100 mol%.

6. A photographic light-sensitive material as in claim 5, wherein the range of c is from 80 to 99.99 mol% and b is from 0.01 to 20 mol%.

7. A photographic light-sensitive material as in claim 5, wherein $R^1$ is a hydrogen atom or a methyl group and n is from 3 to 100.

8. A photographic light-sensitive material as in claim 6, wherein $R^1$ is a hydrogen atom or a methyl group and n is from 3 to 100.

9. A photographic light-sensitive material as in claim 1, wherein the polymer or copolymer is present in an amount of from 0.001 to 0.5 g per $m^2$ of the photographic light-sensitive material.

10. A photographic light-sensitive material as in claim 5, wherein the polymer or copolymer is present in an amount of from 0.001 to 0.5 g per $m^2$ of the photographic light-sensitive material.

11. A photographic light-sensitive material as in claim 6, wherein an amount of the polymer or copolymer used is from 0.001 to 0.5 g per $m^2$ of the photographic light-sensitive material.

12. A photographic light-sensitive material as in claim 7, wherein an amount of the polymer or copolymer used is from 0.001 to 0.5 g per $m^2$ of the photographic light-sensitive material.

13. A photographic light-sensitive material as in claim 8, wherein an amount of the polymer or copolymer used is from 0.001 to 0.5 g per $m^2$ of the photographic light-sensitive material.

14. A photographic light-sensitive material as in claim 1, wherein the ethylenically unsaturated monomer for A is selected from the group consisting of ethylene, propylene, 1-butene, isobutene, styrene, α-methylstyrene, vinyltoluene, monoethylenically unsaturated esters of aliphatic acids, esters of ethylenically unsaturated mono- or dicarboxylic acids and dienes.

15. A photographic light-sensitive material as in claim 1, wherein the ethylenically unsaturated monomer for A is selected from the group consisting of N-vinylpyrrolidone, stearyl methacrylate, styrene, methyl methacrylate and hydroxyethyl methacrylate.

16. A photographic light-sensitive material as in claim 14, wherein L is selected from the group consisting of:

$-COOCH_2\underset{OH}{\underset{|}{C}}HCH_2O\underset{O}{\underset{\|}{C}}CH_2S-$ $\quad$ $-COOCH_2CH_2S-$ -continued

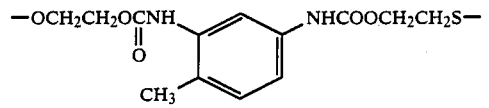

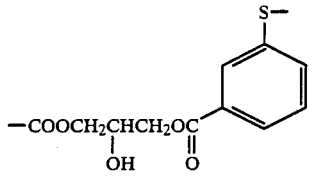

$-NH\underset{O}{\underset{\|}{C}}OCH_2CH_2S-$ $\quad$ $-CONHCH_2CH_2S-$ $-COOCH_2\underset{OH}{\underset{|}{C}}HCH_2O\underset{O}{\underset{\|}{C}}CH_2-$ $\quad$ $-O\underset{O}{\underset{\|}{C}}CH_2S-$ $-O\underset{O}{\underset{\|}{C}}CH_2-$ $\quad$ $-\underset{O}{\underset{\|}{C}}-\overset{CH_3}{\overset{|}{N}}-CH_2CH_2O\underset{O}{\underset{\|}{C}}CH_2S-$ $-\underset{O}{\underset{\|}{C}}OCH_2CH_2S-$ and $-\underset{O}{\underset{\|}{C}}\overset{C_2H_5}{\overset{|}{N}}CH_2CH_2S-$.

17. A photographic light-sensitive material as in claim 14, wherein L is selected from the group consisting of:

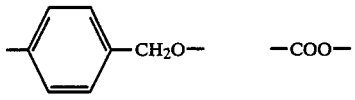

$-COO-$

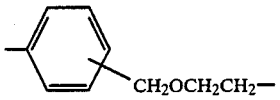

and $-COOCH_2CH_2-$.

18. A photographic light-sensitive material as in claim 14, wherein L is selected from the group consisting of:

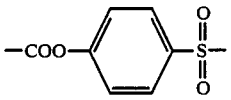

and

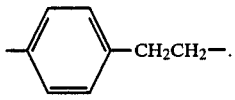

19. A photographic light-sensitive material as in claim 1, wherein A represents a divalent organic group derived from a monomer having an ethylenically unsaturated bond represented by the formula C=C.

20. A photographic light-sensitive material as in claim 1, wherein the ethylenically unsaturated monomer for A is a monoethylenically unsaturated compound.

* * * * *